US005925599A

United States Patent [19]

Smuda

[11] Patent Number: 5,925,599

[45] Date of Patent: Jul. 20, 1999

[54] LUBRICANT BASED ON SILICONE OILS OR SILICONE GREASES

[76] Inventor: Heinrich Smuda, Ben-Gurion-Ring 126, D-60437 Frankfurt am Main, Germany

[21] Appl. No.: 08/860,550

[22] PCT Filed: Oct. 10, 1996

[86] PCT No.: PCT/EP96/04401

§ 371 Date: Jun. 16, 1997

§ 102(e) Date: Jun. 16, 1997

[87] PCT Pub. No.: WO97/14775

PCT Pub. Date: Apr. 24, 1997

[30] Foreign Application Priority Data

Oct. 14, 1995 [DE] Germany ..... 195 38 317

[51] Int. Cl.[6] ..... C10M 131/08

[52] U.S. Cl. ..... 508/215; 508/582; 508/588; 508/589

[58] Field of Search ..... 508/215, 528, 508/588, 589

[56] References Cited

FOREIGN PATENT DOCUMENTS

| | | |
|---|---|---|
| 0125592 | 11/1984 | European Pat. Off. . |
| 125592 | 11/1984 | European Pat. Off. . |
| 201015 | 12/1986 | European Pat. Off. . |
| 126156 | 7/1983 | Poland . |
| 752010 | 4/1956 | United Kingdom . |
| 1123845 | 8/1968 | United Kingdom . |

OTHER PUBLICATIONS

Borek, J Some Chloral Acetals and Their Use in Lubrication. Proc. Conf. Synth. Labr. (1989), 69–73.

Tokarzewski, L. Trichloroacetic Ester Additive to Improve the Lubricating Property of Mineral Oils Inst. Chem. Technol., Univ. Katowice, Pol. Schmierung Sterchnik (1979), 10(6), 179–81.

Tokarzewski, L. Isooctyl Esters of Chloroacetic Acid as Additives Improving transmission–type Silicone Oils Dept. Chem. Technol., Silesian Univ., Katovice, Pol. Izv. Khim (1986), 19(1), 31–5.

*Primary Examiner*—Jacqueline V. Howard
*Assistant Examiner*—Cephia D. Toomer
*Attorney, Agent, or Firm*—Anderson, Kill & Olick, P.C.

[57] ABSTRACT

The invention concerns a lubricant based on silicone oils or silicone greases and is characterized in that it comprises between 95 and 99 wt % silicone oil or silicone grease and between 1 and 5 wt % organic compounds from the group comprising trichloromethyl compounds having at least one oxygen atom in the $sp^3$ configuration.

11 Claims, No Drawings

LUBRICANT BASED ON SILICONE OILS OR SILICONE GREASES

This application is a 371 of PCT/EP96/04401 filed Oct. 10, 1996.

FIELD OF INVENTION

The present invention relates to lubricants based on silicone oils or silicone greases and to the use of an additive to improve their lubricating properties.

The silicone oils are colorless, water-white, oily liquids, which are distinguished by their special chemical stability. They are very resistant to oxidizing processes and also have many other advantages, such as

- a very high viscosity index, which is between 300 and 400 for light oils and between 170 and 250 for heavy oils. The viscosity index determines the slope of the viscosity-temperature curve. Silicone oils are also distinguished by the fact that their viscosity changes relatively little as the temperature is increased, particularly in comparison with mineral oils.
- A minimal vapor pressure, that is, very high boiling temperatures and, with that, a low flammability. Silicone oils, particularly heavy oils, are practically incombustible.
- Very low solidifying temperatures between −70° C. and less than −100° C. As a result, the limits to the use of silicone oils are unusually broad.
- Insolubility in water, mineral oils and many other inorganic and organic solvents.
- Not toxic to people and animals. Silicone oils or silicone greases can be introduced into the living organism without harm.

Despite these advantages, silicone oils or silicone greases have the disadvantage of that of a low lubricity. The lubricity of silicone oils is at the same level as the lubricity of water. The lubricity is expressed by the so-called weldability, which can be measured with the help of the four-ball machine. The weldability of silicone oils is only 80 kg or, in SI units, 80 daN. On the other hand, the weldability of engine oils is 170 to 200 kg and that of transmission oils is even 300 and higher. The latter data relates to the so-called EP oils (Extreme Pressure Lubricants).

In order to achieve these properties, mineral oils are improved with various additives.

Up to now, it has not been possible to improve silicone oils or silicone greases on the basis, on which other synthetic or natural mineral oils are improved, that is, by additives, because the typical additives, such as phosphate and thiophosphate esters, which are used successfully in other cases, do not dissolve in silicone oils or silicone greases. After all, it is a general property of silicone oils and silicone greases that almost no materials are soluble in them.

A first partial solution of this problem resulted from the chlorination of silicone oils. Chlorinated methylsilicone oils have not only improved but even outstanding lubricating properties. However, their stability is low and they tend to split off hydrogen chloride, which gives rise to an acidic reaction. A different possibility is the stabilization of chlorosilicones by means of epoxides, for example, in the form of glycidyl ethers. However, the chlorination of silicone oils, to a certain extent, is difficult, as is the de-acidification of these oils. The need for additional stabilization increases the costs of these silicone oils and complicates methods for improving them.

It is therefore an object of the present invention to provide lubricants based on silicone oils or silicone greases, which have particularly good lubricating properties and a high stability particularly in metal lubrication technology, in order to reduce the rate of wear of components that are to be lubricated and, with that, to increase their service life appreciably.

Pursuant to the invention, this objective is accomplished by a lubricant based on silicone oils or silicone greases, which is characterized by 95–99% by weight of silicone oil or silicone grease and 1–5% by weight of organic compounds from the group comprising trichloromethyl compounds, which have at least one oxygen atom in the $sp^3$ configuration and are described by the general formula

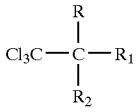

As an organic compound, e.g., butylhemiacetal of chloral or 1,1,1-trichlor-2-methylpropanol-2 can be used.

In the above-described general formula, the following combinations of R substitutes are possible:

R = (H);
$R_1 = R_2 = (—OCH_3)$, $(—OC_2H_5)$, (n-, iso-, sec-$OC_4H_9$),
R = (H);
$R_1$ = (OH); $R_2 = (—OCH_3)$, $(—OC_2H_5)$, (iso-$OC_3H_7$) (iso-$OC_4H_9$), $(—O—CH_2CH{=}CH_2)$ (iso-$OC_8H_{17}$), $(—O—CH_2CH_2OH)$ $(—O—CH(CH_3)—CH_2OH)$,
R = (H);
$R_1 = (—OC_2H_5)$; $R_2$ = (n-, iso-$OC_3H_7$), (n-, iso-, sec-$OC_4H_9$),
R = (H);

$R_1$ and $R_2$ are cyclic acetals, such as $(—OCH_2CH_2O—)$ or $(—OCH(CH_3)—CH_2—O—)$,
R = (H);
$R_1 = (—OH)$; $R_2 = (—H)$, $(—CH_3)$, $(—O_2H_5)$; (n-$C_3H_7$) (iso-$C_3H_7$), (n-$C_4H_9$), (sec-$C_4H_9$) (iso-$C_4H_9$), $(—CH_2Ph)$, (—Ph), (-4 1,3 dihydroxyphenyl) (-p-hydroxyphenyl), p-methoxyphenyl),
R = $R_1$ = H;
$R_2 = (—CH_2OH)$; $(—CH_2CH_2OH)$ $(—CH_2CH_2CH_2OH)$,
R = $(—CH_3)$; $R_1 = (—OH)$;
$R_2 = (—C_2H_5)$ (n-$C_3H_7$), or
R = (—OH); $R_1 = R_2 = (—C_2H_5)$.

In all cases, it is of advantage if, the silicone oil or the silicone grease is a methylsilicone oil or a phenylsilicone oil or a methylsilicone grease or a phenylsilicone grease.

The use of these additives as improving agents in the form of additives for silicone oils or silicone greases is simple and relatively inexpensive in production. Furthermore, it enables silicone oils to be obtained, which are suitable for lubricating purposes with any welding load values, that is, even for oils of the EP type.

Investigations with silicone oils were carried out with and without the above-mentioned additives. The above-mentioned, conventional four-ball apparatus was not used as test equipment, since the results achieved with it do not approximate real conditions closely enough. Rather, an anti-friction bearing under the test stand conditions of FAG Schweinfurth was used as test object. It has gained acceptance worldwide as the standard testing equipment for investigating lubricants. The investigation of the silicone oil without additive under mixed friction conditions at the test stand has shown that, after less than 1 hour of experimental time, the silicone oil has turned black. After about 4 hours, the test had to be discontinued, because the rate of wear had increased precipitously. The relative rate of wear of the anti-friction bearing tested is about 80 to 100% when a silicone oil without additives is used and about 2 to 10% when a silicone oil with inventive additives is used.

Special advantages arise when the silicone oil or the silicone grease is a methyl or phenylsilicone oil or methyl or phenylsilicone grease for a lubricant of claim 12.

The compositions and properties of the inventive lubricants are described in greater detail by three examples.

EXAMPLE 1

After being heated to about 90° C., 99% to 95% of a silicone oil 1000 is mixed with 1 to 5% by weight of an organic compound from the group of trichloromethyl compounds of claim 1. This results in a clear solution with a welding load of 200 to 600 daN.

EXAMPLE 2

After being heated to about 80° to 90° C., 99% by weight of silicone oil 1000 is mixed with 1% by weight of 1,1,1-trichloro-2-methylpropan-2-ol. This results in a clear solution, the welding load of which is 200 daN. The addition of 3% by weight of Chloreton results in a solution with a welding load of 430 daN.

EXAMPLE 3

The butyl semiacetal of chloral (3% by weight) is dissolved in heated 97% by weight of silicone oil 350 until homogeneity is attained. The clear solution has a weld load of 560 daN.

I claim:

1. A lubricant based on silicone oils or silicone greases, characterized by

95–99% by weight of silicone oil or silicone grease and

1–5% by weight of organic compounds from the group comprising trichloromethyl compounds, which have at least one oxygen atom in the $sp^3$ configuration and are described by the general formula

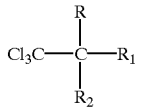

wherein:

R=(H);

$R_1$=(—$OCH_3$), (—$OC_2H_5$), or (n-, iso-, sec-$OC_4H_9$), $R_2$=(—$OCH_3$), (—$OC_2H_5$), or (n-, iso-, sec-$OC_4H_9$).

2. A lubricant based on silicone oils or silicone greases, characterized by

95–99% by weight of silicone oil or silicone grease and

1–5% by weight of organic compounds from the group comprising trichloromethyl compounds, which have at least one oxygen atom in the $sp^3$ configuration and are described by the general formula

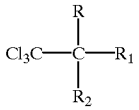

wherein:

R = (H);

$R_1$ = (OH); $R_2$ = (—$OCH_3$), (—$OC_2H_5$), (iso-$OC_3H_7$), (iso-$OC_4H_9$), (—O—$CH_2CH$═$CH_2$)—, (iso-$OC_8H_{17}$), (—O—$CH_2CH_2OH$), or (—O—CH(—$CH_3$)—$CH_2OH$).

3. A lubricant based on silicone oils or silicone greases, characterized by

95–99% by weight of silicone oil or silicone grease and

1–5% by weight of organic compounds from the group comprising trichloromethyl compounds, which have at least one oxygen atom in the $sp^3$ configuration and are described by the general formula

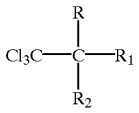

wherein:

R=(H);

$R_1$=(—$OC_2H_5$); $R_2$=(n-, iso-, or $OC_3H_7$), or (n-, iso-, or sec-$OC_4H_9$).

4. A lubricant based on silicone oils or silicone greases, characterized by

95–99% by weight of silicone oil or silicone grease and

1–5% by weight of organic compounds from the group comprising trichloromethyl compounds, which have at least one oxygen atom in the $sp^3$ configuration and are described by the general formula

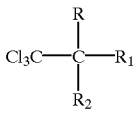

wherein:

R=(H);

$R_1$ and $R_2$ are cyclic acetals, such as (—$OCH_2CH_2O$—) or (—OCH(—$CH_3$)—$CH_2$—O—).

5. A lubricant based on silicone oils or silicone greases, characterized by

95–99% by weight of silicone oil or silicone grease and

1–5% by weight of organic compounds from the group comprising trichloromethyl compounds, which have at least one oxygen atom in the $sp^3$ configuration and are described by the general formula

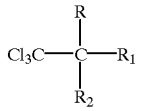

wherein:

R = (H);

$R_1$ = (—OH); $R_2$ = (—H), (—$CH_3$), (—$O_2H_5$), ($n$-$C_3H_7$) (iso-$C_3H_7$), ($n$-$C_4H_9$), (sec-$C_4H_9$), (iso-$C_4H_9$), (—$CH_2$Ph), (—Ph), (-4 1,3 dihydroxphenyl) (-p-hydroxyphenyl or, p-methoxyphenyl).

6. A lubricant based on silicone oils or silicone greases, characterized by

95–99% by weight of silicone oil or silicone grease and

1–5% by weight of organic compounds from the group comprising trichloromethyl compounds, which have at least one oxygen atom in the $sp^3$ configuration and are described by the general formula

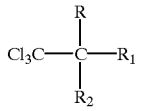

wherein:

R = $R_1$ = H;

$R_2$ = (— $CH_2OH$), (— $CH_2CH_2OH$) or (— $CH_2CH_2CH_2OH$).

7. A lubricant based on silicone oils or silicone greases, characterized by

95–99% by weight of silicone oil or silicone grease and

1–5% by weight of organic compounds from the group comprising trichloromethyl compounds, which have at least one oxygen atom in the $sp^3$ configuration and are described by the general formula

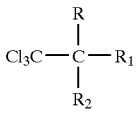

wherein:

R = (— $CH_3$); $R_1$ = (— OH); $R_2$ = (— $C_2H_5$) or ($n$-$C_3H_7$).

8. A lubricant based on silicone oils or silicone greases, characterized by

95–99% by weight of silicone oil or silicone grease and

1–5% by weight of organic compounds from the group comprising trichloromethyl compounds, which have at least one oxygen atom in the $sp^3$ configuration and are described by the general formula

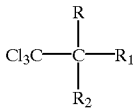

wherein R=(—OH); $R_1$=$R_2$=(—$C_2H_5$).

9. A lubricant based on silicone oils or silicone characterized by

95–99% by weight of silicone oil or silicone grease and

1–5% by weight of butylhemiacetal of chloral.

10. The lubricant based on silicone oils or silicone greases, characterized by 95–99% by weight of silicone oil or silicone grease and 1–5% by weight of 1,1,1-trichloro-2-methylpropan-2-ol.

11. The lubricant of one of claims 9 or 10, characterized in that silicone oil or the silicone grease is a methyl or phenylsilicone oil or a methyl or phenylsilicone grease.

* * * * *